United States Patent [19]

Sandoy

[11] 4,186,464

[45] Feb. 5, 1980

[54] CHAIN STOPPER

[75] Inventor: Harry S. Sandoy, Kolbjornsvik, Norway

[73] Assignee: Pusnes Mek, Verksted A/S, Pusnes, Norway

[21] Appl. No.: 899,240

[22] Filed: Apr. 24, 1978

[30] Foreign Application Priority Data

Apr. 28, 1977 [NO] Norway ..... 771497

[51] Int. Cl.[2] ..... F16G 15/04; B63G 21/18

[52] U.S. Cl. ..... 24/116 R; 114/200

[58] Field of Search ..... 24/116 R; 114/200

[56] References Cited

U.S. PATENT DOCUMENTS

| | | | |
|---|---|---|---|
| 311,573 | 2/1885 | Emery | 114/200 |
| 2,014,201 | 9/1935 | Field | 24/116 R |
| 3,536,024 | 10/1970 | Bugaenko | 114/200 |
| 3,547,066 | 12/1970 | Bugaenko | 114/200 |
| 3,803,942 | 4/1974 | Duggan | 114/200 |
| 3,805,728 | 4/1974 | Abraham | 114/200 |
| 4,070,981 | 1/1978 | Guinn | 114/200 |

FOREIGN PATENT DOCUMENTS

| | | | |
|---|---|---|---|
| 366114 | 4/1973 | U.S.S.R. | 114/200 |

*Primary Examiner*—Bernard A. Gelak

*Attorney, Agent, or Firm*—Howson and Howson

[57] ABSTRACT

An improvement in the class of chain stopper comprising a framework having a chain track extending through it for receiving the chain and a pawl which is pivotably attached at one of its ends to the framework and comprising two parts pivotably connected to each other in the fashion of a toggle link which remains substantially unbent in its chain-stopping position and is actuated to a bent position when the chain is released; this class of chain stopper also comprises an arm pivotably attached at one of its ends to the other end of the pawl and pivotably attached at its other end to the framework, this arm having a bearing portion resting against, and substantially conforming to, the surface of the chain when the pawl is in its chain stopping position. According to this improvement, the pivot axis of the pivotable attachment of the pawl to the framework and the pivot axis of pivotable attachment of the arm to the framework lie on opposite sides of a plane perpendicular to the chain track and which extends through the axis of pivotable attachment of the arm to the pawl, with advantages in reducing stress and frictional forces.

2 Claims, 4 Drawing Figures

CHAIN STOPPER

The invention relates to an arrangement in or relating to a chain stopper, comprising a framework, a track extending through the framework for the chain and a pawl which at one end is pivotably mounted in the framework and comprises two parts connected with each other after the fashion of a toggle link which is kept substantially unbent in the locking position of the pawl.

Chain stoppers of the kind specified are used inter alia for the anchoring of floating drilling rigs at sea and for mooring of tankers to loading buoys for oil. In the last-mentioned case a mooring cable of synthetic fibre is preferably used with a stretch of chain at the end attached on board the tanker, to reduce wear in the fairlead or the like. The articulated construction of the pawl enables the chain to be released quickly without being further hauled in when this is desirable, for instance, in an emergency.

In the prior art installations, for instance, as disclosed in Norwegian Pat. No. 134 978, one of the two parts of the pawl, connected after the fashion of a toggle link, rests directly against one of the links of the chain.

When the pawl is released—i.e., when the toggle links bends—, the aforementioned part of the pawl must slide against the chain link. The sliding takes place while very considerable forces are still transmitted from the chain to the pawl, and since at least the contact surface of the chain link is unmachined, considerable frictional forces will be produced. They can easily damage both the chain link and the pawl part, and moreover mean that considerable forces are required for the release (bending) of the pawl.

It is difficult to calculate the frictional forces with any particular degree of accuracy, so that the release system of the pawl must be overdimensioned to ensure an adequate release force under the most unfavourable conditions possible.

It is an object of the invention to reduce the aforementioned disadvantage and defects to a considerable extent. This is achieved according to the invention by an arrangement of the kind specified whose novel and characteristic feature is that the chain end of the pawl has a pivotably attached bearing part which rests against the chain in the locking position of the pawl.

Other advantageous features of the invention can be gathered from the sub-claims. The pivotable connection between the pawl and the bearing part is advantageously constructed in the form of a bearing with accurately machined surfaces. These, if necessary assisted by suitable lubricants, will produce low and readily predictable friction, a feature which enables the pawl to be released without using considerable forces.

Moreover, the bearing part will remain lying in the space against the chain during the initial release of the pawl, thus obviating harmful friction and sliding between the pawl and the chain.

For the better understanding of the invention it will now be explained in greater detail with reference to the embodiment illustrated in the drawings.

Figure 1:
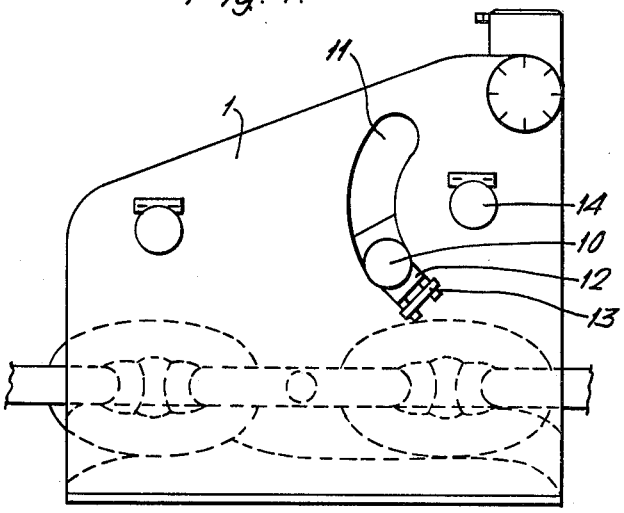
FIG. 1 is a side of a chain stopper according to the invention.

The drawings show a framework 1 mainly formed by two side walls 2 and a base part 3 connecting the latter. Disposed in the base part is a track 4 for a chain. Its horizontally and vertically oriented links, having the references 5 and 6 respectively, are shown in fine lines on certain of the drawings.

The track affords a location for the lower part of the vertical links 6 and continues at the top into horizontal surfaces 7 forming a support for the horizontal links.

The pawl of the chain stopper comprises two parts 8, 9 which are connected to one another after the fashion of a toggle link by means of a spindle 10 whose ends extend out of cut-away portions 11, in the form of arcs of circles, in the side walls 2. In the locking position of the pawl the ends of the spindle 10, rest in saddle members 12 which are adjustably supported by brackets 13 attached to the walls 2.

At the opposite end of the toggle link the pawl part 8 is pivotably attached between the walls 2 by means of a spindle 14. At this end the pawl part 8 has a forked prolongation 15, and disposed between the two prongs of the fork is a pin 16 extending through a slot 17 in a piston rod 18 associated with a hydraulic cylinder 19. The cylinder 19 is pivotably attached by means of pivot pins 20 mounted in the side walls 2.

Figure 2:
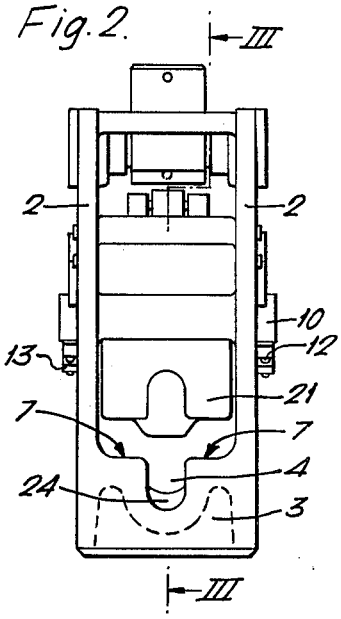
FIG. 2 is a rear view of the chain stopper, viewed in the longitudinal direction of the chain.
Figure 3:
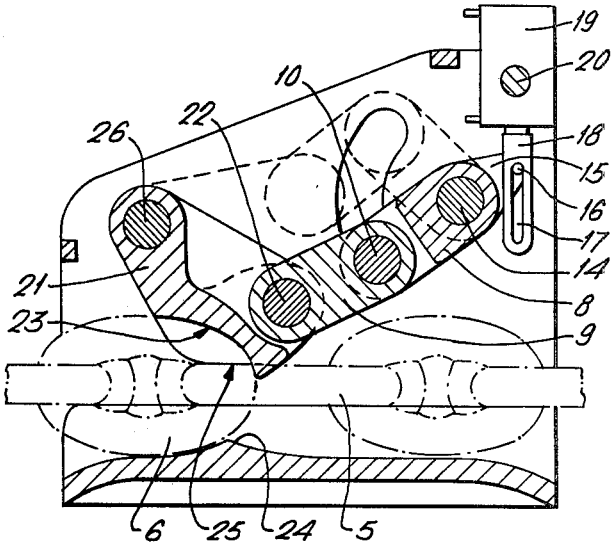
FIG. 3 is a section, taken along the line III—III in FIG. 2.
Figure 4:
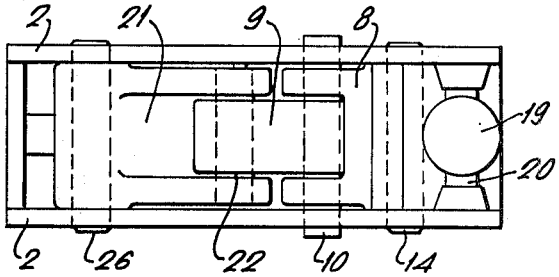
FIG. 4 is a plan view of the chain stopper.

At the opposite end of the toggle link the pawl part 9 is pivotably attached to a bearing part 21 by means of a spindle 22. The bearing part is given a surface shape which causes it to follow the outline of the chain and to contact the chain over a relatively large area in the locking position of the pawl. The result is a relatively low surface pressure on the chain, and therefore a reduced likelihood of its becoming damaged and deformed. Thus as can be seen in FIG. 3, the bearing part 21 rests by the surface 23 against the upper part of the vertical link 6. The lower part of the link advantageously rests against a ridge 24 in the track 4. The bearing part also rests against the horizontal link 5 by surfaces 25 and presses it into positive contact with the surfaces 7 in the base part 3 (FIG. 2). This retention of the link 5 contributes towards retaining the link 6 in the correct position, so that it is subjected to the minimum possible stressing in the locked condition.

In the example illustrated the bearing part 21 takes the form of an arm which at its end remote from the spindle 22 is pivotably attached to the side walls 2 of the framework 1 via a spindle 26. This construction means that the pawl is controlled during its release and also ensures the movement of the bearing part out of the path of the chain. It also ensures that the bearing part assumes the correct position during the locking of the chain and that the pawl remains in the loaded position until the intended release takes place.

When the chain stopper illustrated is in the locked condition, its individual parts will be in the position shown in continuous lines in FIG. 3. The spindle 10 connecting the two pawl parts 8, 9 rests against the saddle members 12, which are so adjusted that the centre line of the spindle 10 has a slightly undercentred eccentricity in relation to the plane through the centre lines of the spindles 14 and 22. The threelink mechanism formed by the two pawl parts 8 and 9 and the arm 21 is therefore locked for any force which can be transmitted from the chain when it is streched (to the right as viewed in FIGS. 1 and 3).

In the release of the chain stopper the hydraulic cylinder 19 can be used. The piston rod 18 of the cylinder forces the pin 16 on the prolongation 15 of the pawl part 8 downwards, so that the toggle link spindle 10 is moved from the undercentred into the overcentred position. Sliding takes place without appreciable friction in the bearings for the spindles 10, 14 and 22. There will be no sliding between the bearing part 21 and the chain links 5 and 6.

As soon as the toggle link is overcentred, the force from the chain will contribute towards a further bending effect, and the pawl parts 8, 9 and the bearing part 21 can, if necessary assisted by the cylinder 19, take up the position shown in broken lines in FIG. 3, so that the chain can pass unimpeded through the chain stopper.

I claim:

1. In a chain stopper comprising a framework; a chain track extending through said framework for receiving said chain; a pawl pivotably attached at one of its ends to said framework and comprising two parts pivotably connected to each other in the fashion of a toggle link which remains substantially unbent in the chain-stopping position of said pawl and is actuated to a bent position when said chain is released; and an arm pivotably attached at one of its ends to the other end of said pawl and pivotably attached at its other end to said framework, said arm having a bearing part resting against and substantially conforming to the surface of said chain when said pawl is in its chain-stopping position; the improvement wherein the pivot axis of pivotable attachment of said pawl to said framework and the pivot axis of pivotable attachment of said arm to said framework are on opposite sides of a plane which is perpendicular to said chain track and which extends through the axis of pivotable attachment of said arm to said pawl.

2. The arrangement of claim 1, wherein the distance between said chain track and said axis of pivotable attachment of said arm to said framework is greater than the distance between said chain track and the axis of pivotable attachment of said arm to said pivot, when said pivot is in its chainstopping position.

* * * * *